US008088269B1

(12) United States Patent
Tarcy et al.

(10) Patent No.: US 8,088,269 B1
(45) Date of Patent: Jan. 3, 2012

(54) SYSTEM AND METHOD FOR MEASURING ALUMINA QUALITIES AND COMMUNICATING THE SAME

(75) Inventors: Gary Tarcy, Murrysville, PA (US); Eliezer Batista, Pittsburgh, PA (US); Xiangwen Wang, Murrysville, PA (US)

(73) Assignee: ALCOA Inc., Pittsburgh, PA (US)

( * ) Notice: Subject to any disclaimer, the term of this patent is extended or adjusted under 35 U.S.C. 154(b) by 0 days.

(21) Appl. No.: 12/854,612

(22) Filed: Aug. 11, 2010

Related U.S. Application Data

(63) Continuation of application No. 12/506,877, filed on Jul. 21, 2009, now abandoned.

(51) Int. Cl.
*C25C 3/14* (2006.01)
*C25C 3/20* (2006.01)

(52) U.S. Cl. ..... 205/392; 205/389; 205/372; 205/336; 204/247.1; 204/245; 204/243.1

(58) Field of Classification Search ..... 204/243.1, 204/245, 247.1; 205/372, 389, 392, 336
See application file for complete search history.

(56) References Cited

U.S. PATENT DOCUMENTS 4,321,115 A * 3/1982 Rebmann et al. ..... 205/392
4,328,085 A * 5/1982 Friedli et al. ..... 204/245
4,437,964 A * 3/1984 Gerphagnon et al. ..... 204/245
4,654,130 A * 3/1987 Tabereaux et al. ..... 205/336
4,766,552 A * 8/1988 Aalbu et al. ..... 700/268
4,814,050 A * 3/1989 McGraw et al. ..... 205/336
5,108,557 A * 4/1992 Nordquist ..... 205/392
5,324,408 A * 6/1994 Kissane ..... 204/245
5,423,968 A * 6/1995 Kissane ..... 204/245
5,476,574 A * 12/1995 Welch et al. ..... 205/392
6,942,381 B2 9/2005 Hosler et al. ..... 374/139
7,731,824 B2 6/2010 Slaugenhaupt et al. ..... 204/247
2007/0295615 A1 12/2007 Wang et al. ..... 205/775
2010/0243460 A1 9/2010 Wang et al. ..... 205/82

OTHER PUBLICATIONS

Dyroy, A. et al., "Effects of Segregation on the Environment and Yield in Aluminium Production," pp. 12, 14-15, The Postec Newsletter No. 20, available at www.tel-tek.no, Tel-Tek, Porsgrunn, Norway, Nov. 2001.

Ose, S., et al., "Using Noise to Predict Particle Size and Segregation Online," p. 16, The Postec Newsletter No. 20, available at www.tel-tek.no, Tel-Tek, Porsgrunn, Norway, Nov. 2001.

* cited by examiner

*Primary Examiner* — Bruce Bell
(74) *Attorney, Agent, or Firm* — Greenberg Traurig, LLP

(57) ABSTRACT

System and method for measuring alumina qualities and communicating the same are disclosed. In one example, a system includes an aluminum electrolysis cell, a feeder configured to supply a feed stock using a feed stream to the aluminum electrolysis cell, and a measurement device in communication with the feed stream, the measurement device adaptable to receive, release, and determine at least one attribute associated with the feed stock.

18 Claims, 4 Drawing Sheets

SYSTEM AND METHOD FOR MEASURING ALUMINA QUALITIES AND COMMUNICATING THE SAME

CROSS-REFERENCE TO RELATED APPLICATION

This application is a continuation of U.S. patent application Ser. No. 12/506,877, filed Jul. 21, 2009, entitled "SYSTEM AND METHOD FOR MEASURING ALUMINA QUALITIES AND COMMUNICATING THE SAME," which is incorporated herein by reference in its entirety.

BACKGROUND

Aluminum metal may be produced by electrolysis in a cell superstructure. Inside such superstructure, alumina powders ($Al_2O_3$), being fed to a pot containing a liquid bath, may have to dissolve before being reduced to metallic aluminum by electrolysis. However, some alumina powders may not dissolve instantaneously since each batch of alumina powder may have a different dissolution rate. The variety of factors influencing dissolution rate include changes in ore source, refinery processing conditions, and shipment and storage segregation, to name a few. Being able to determine the alumina dissolution rate and to proactively adjust the alumina feed rate to the pot are two factors in maintaining high pot energy efficiency, reducing environmental impact by reducing anodic effect and muck formation.

SUMMARY

System and method for measuring alumina qualities and communicating the same are disclosed. One embodiment discloses a system having an aluminum electrolysis cell, a feeder configured to supply a feed stock via a feed stream to the aluminum electrolysis cell, and a measurement device in communication with the feed stream, whereby the measurement device is adaptable to receive a first portion of the feed stock, release a second portion of the feed stock during a first time period, and determine at least one attribute associated with the feed stock by correlating the first time period with the second portion of the feed stock. In some embodiments, the measurement device is adaptable to communicate the attribute to a host computer via a network.

In one embodiment, the feed stock comprises alumina. In another embodiment, the second portion of the feed stock may be released into the feed stream. In some embodiments, the attribute includes at least one of weight, flow rate, concentration and particle size of the feed stock. In one instance, the measurement device may be coupled to an exterior portion of at least one of the aluminum electrolysis cell and the feeder. Alternatively, the measurement device may be coupled to an interior portion of at least one of the aluminum electrolysis cell and the feeder. In one embodiment, the measurement device is a funnel.

One embodiment discloses a method comprising: (a) supplying a feed stock via a feed stream to an aluminum electrolysis cell, (b) receiving a first portion of the feed stock via a measurement device, (c) releasing a second portion of the feed stock from the measurement device over a first time period, and (d) determining a first attribute associated with the feed stock, wherein the determining comprises correlating the first time period to a second attribute of the second portion of the feed stock. In one embodiment, the measurement device is in communication with the feed stream.

In one embodiment, the method further includes: (e) communicating the attribute to a host computer via a network. In another embodiment, the method further includes: (f) adjusting alumina feed control including at least one of feed rate of the feed stream based on the attribute.

Other variations, embodiments and features of the present disclosure will become evident from the following detailed description, drawings and claims.

DETAILED DESCRIPTION

It will be appreciated by those of ordinary skill in the art that the disclosure can be embodied in other specific forms without departing from the spirit or essential character thereof. The presently disclosed embodiments are therefore considered in all respects to be illustrative and not restrictive.

Broadly, the present disclosure relates to system and method for measuring alumina qualities and communicating the same. The ability to measure alumina properties in real-time may facilitate immediate and instantaneous adjustment of alumina feed rate thereby improving energy efficiency, reducing muck formation, and minimizing anodic effect.

As used herein, "energy efficiency" is defined as the ratio between voltage and current efficiency. In general, the lower the energy consumption, the higher the energy efficiency. In some instances, when alumina particle sizes become too coarse or there is too much superfines in the alumina, feed control parameters may be adjusted to allow additional time for alumina dissolution between feed shots. This will become more apparent in subsequent figures and discussion.

As used herein, "muck formation" refers to the buildup of un-dissolved alumina that collects at the bottom of a pot within a cell superstructure. Bad quality alumina ores may impact dissolution rates. Once the alumina ore is fed to a pot, there is a certain amount of time that it has to be dissolved (e.g., 3 minutes). If it does not dissolve, it may fall to the bottom of the pot and gather into a pile of sludge or muck. In some instances, muck formation may lead to anodic effect. Alternatively, reducing muck formation may lead to lower energy consumption due to the reduction in pot voltage and the increase in energy efficiency.

As used herein, "anodic effect" refers to a high voltage condition at the anode which generates carbon monoxide and carbon tetrafluoride ($CF_4$). In other words, instead of generating aluminum metal, sodium and carbon tetrafluoride are produced. In some instances, anodic effect may lead to energy inefficiency, increases in pot temperature, and consumption of the carbon anode. An unstable pot may lead to increased voltage and cause the pot to have to be operated at higher energy consumption (e.g., higher energy and temperature) thereby decreasing energy efficiency.

Figure 1:
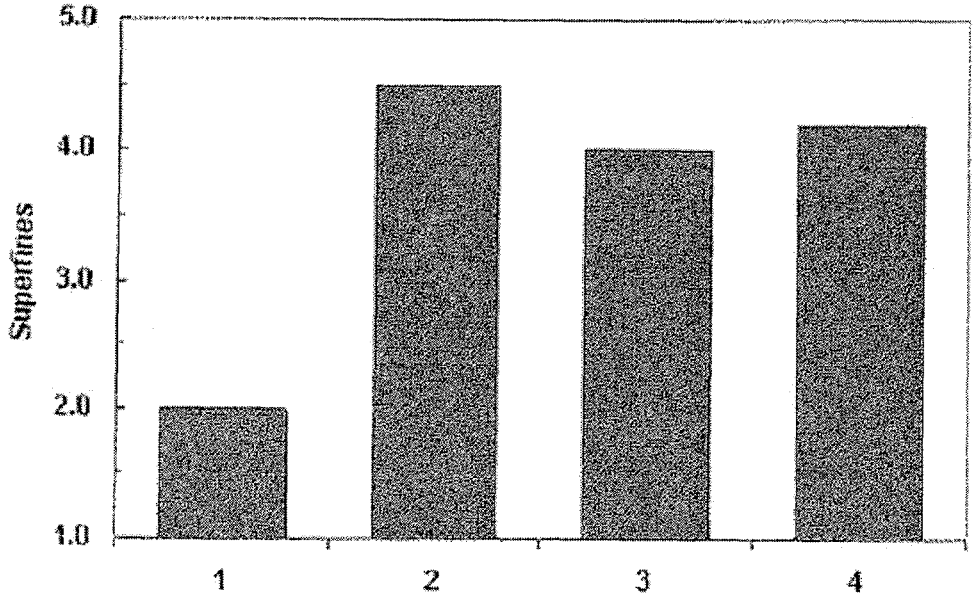
FIG. 1 shows a variation in concentration of superfines in alumina ores being fed to four different pots at the same time.

Alumina ores (e.g., in powder form) being fed to a liquid bath inside a pot have to be dissolved into liquid form in order to be electrolyzed. Solid forms of alumina feed have difficulty being reduced to metallic aluminum by electrolysis. Different batches of alumina may have different dissolution rates and do not dissolve at the same rate. FIG. 1 shows a variation in concentration of superfines in alumina ores being fed to four different pots at the same time. As shown, pot 1 is being supplied with alumina ores having superfines concentration of about 2.0%, while pot 2 is being supplied with alumina ores having superfines concentration of about 4.5%. In these instances, alumina dissolution rate may be affected by alumina quality (e.g., amount of superfines). In most instances, because lower concentration of superfines may lead to higher dissolution rate while higher concentration of superfines may lead to lowered dissolution rate, pot 2 will most likely experience higher operating difficulties (e.g., increased muck formation and anode effects) versus that of pot 1 if no adjustment is made to the alumina feed (e.g., slower or faster feed, using a different batch of alumina).

Figure 2:
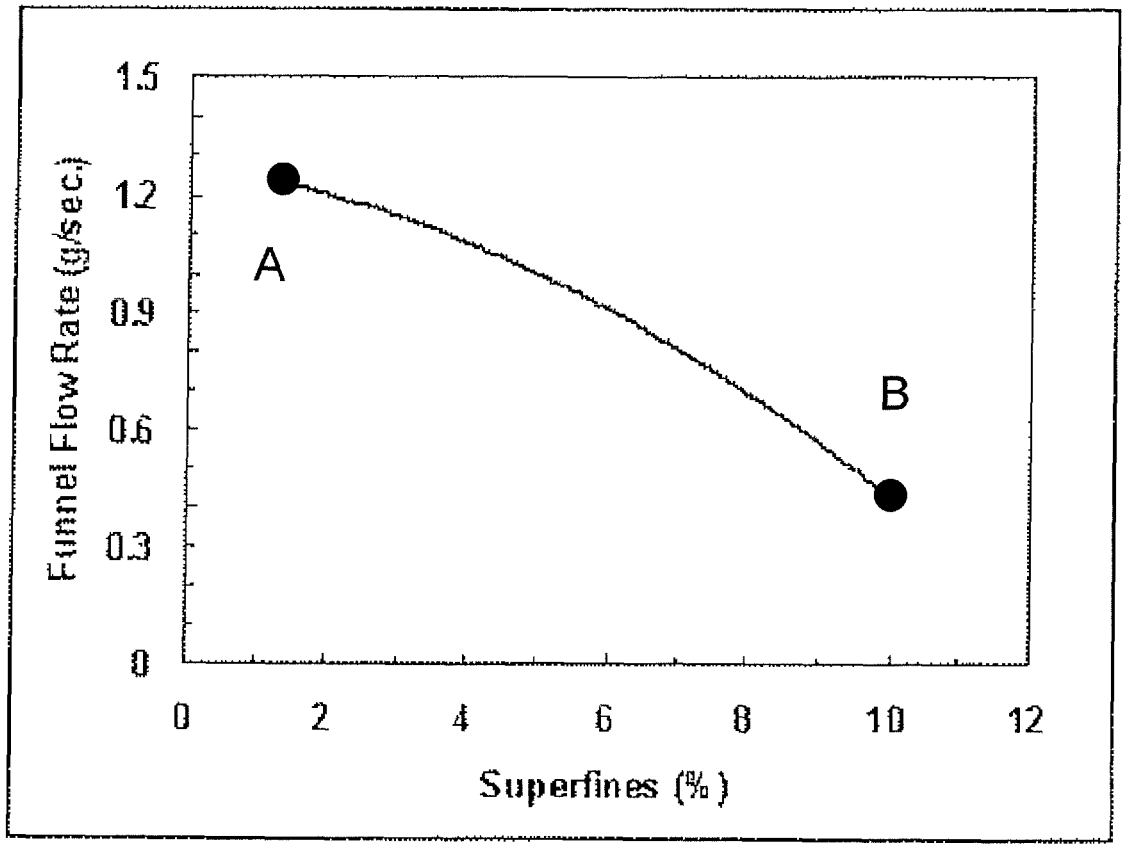
FIG. 2 is an illustration of alumina flow rate as a function of superfines.

FIG. 2 is an illustration of alumina flow rate as a function of amount of superfines. As shown, when a batch of alumina contains a lower concentration of superfines (e.g., point A—from about 1 to about 2%), the alumina may achieve a higher flow rate (e.g., from about 1.2 to about 1.3 g/sec) because there are fewer superfines particles to disrupt the flow of alumina particles. Alternatively, when a batch of alumina contains a higher concentration of superfines (e.g., point B—about 10%), the alumina may achieve a lower flow rate (e.g., from about 0.4 to about 0.5 g/sec) because there are more superfines particles to disrupt the flow of alumina particles. Therefore, by being able to determine an alumina property (e.g., alumina flow rate), the concentration of superfines may be predicted and feed control parameters may be adjusted accordingly to minimize muck generation and anodic effect within the cell superstructure during the electrolytic production of metallic aluminum. In one embodiment, the alumina feed control parameters may be adjusted in real-time (e.g., immediate or instantaneously).

Figure 3:
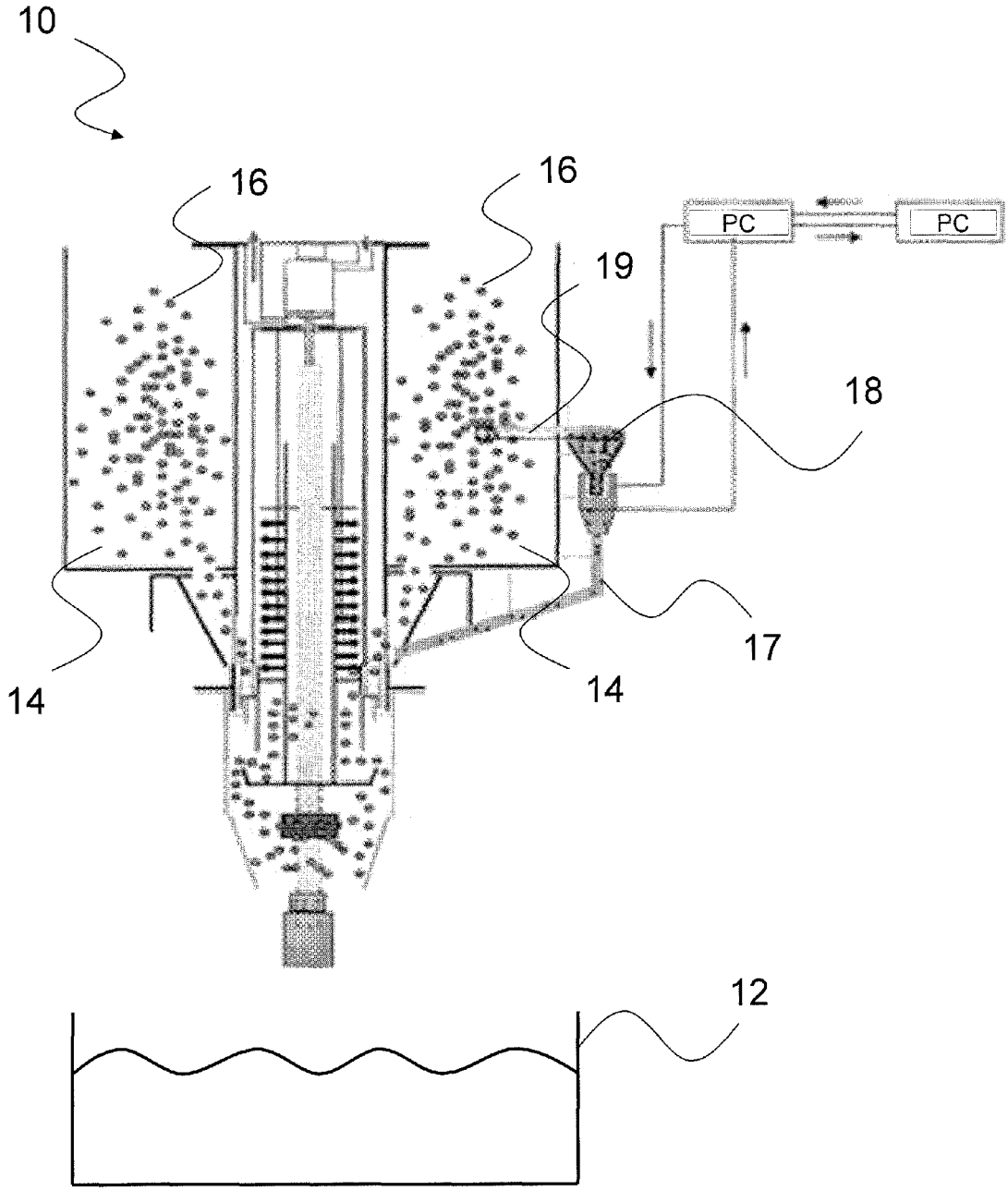
FIG. 3 illustrates one embodiment of a measurement device coupled to an aluminum electrolysis cell.

FIG. 3 illustrates one embodiment of an aluminum electrolysis cell having a cell superstructure 10 and a pot 12 containing an electrolytic bath, among other components. As used herein, "aluminum electrolysis cell" and the like means a structure used in an electrolytic process for the manufacturing of metallic aluminum. For example, the aluminum electrolysis cell may include a cell superstructure 10 with the following components: anode and cathode, and electrolytic bath containing pot 12, to name a few.

As used herein, "electrolytic process" and the like means a chemical decomposition reaction produced by passing an electric current through an ionic solution. In some instances, the terms "electrolytic process" and "electrolysis" are used interchangeably.

As used herein, "electrolytic bath" and the like means an ionic solution or electrolyte for passing electric current through in carrying out an electrolytic process. In some embodiments, the electrolytic bath may contain molten or solid electrolytes.

In one embodiment, at least one feeder 14 may be coupled to the sides of the cell superstructure 10 as shown in FIG. 1. As used herein, "feeder" and the like means a container for storing and supplying feed stock 16 to an aluminum electrolysis cell. For example, a feeder 14 may store alumina and supply the same to an aluminum electrolysis cell. In some instances, a feeder 14 may also be referred to as a feed hopper or a hopper. In one embodiment, a feeder 14 is configured to store feed stock 16 (e.g., alumina powder), and supply the same via a feed stream to an electrolyte containing pot 12. In some instances, the feeder 14 need not be coupled to the cell superstructure 10 but may be situated adjacent to the cell superstructure 10 for supplying the feed stock 16 to a portion of the aluminum electrolysis cell.

As used herein, "supply" and the like means the act of supplying or providing something. For example, a feed stock 16 may be supplied from a feeder 14 via a feed stream to an aluminum electrolysis cell in accordance with the processing requirements for the manufacturing of metallic aluminum. In one instance, alumina may be supplied from a hopper via a feed stream to a liquid bath within a pot 12 of the aluminum electrolysis cell for the manufacturing of metallic aluminum.

As used herein, "feed stock" and the like means a material used in the manufacturing of metallic aluminum. In one embodiment, the feed stock 16 comprises alumina. In some embodiments, the feed stock 16 includes at least one of alumina, alumina powder, smelter grade alumina (SGA) powder, and particulate fines, to name a few. In these instances, the size of the powder particles can vary from submicron to about 150 microns. In some instances, the average diameter of the powder particles is from about 85 to about 95 microns. In some embodiments, particulate fines are particles having maximum diameter of not greater than about 45 microns, or not greater than about 40 microns, or not greater than about 35 microns, or not greater than about 30 microns, or not greater than about 25 microns. In other embodiments, particulate fines may have an average diameter of not greater than about 20 microns, or not greater than about 18 microns, or not greater than about 15 microns, or not greater than about 10 microns. Particulate fines generally have an average diameter of at least about 0.5 microns. In one embodiment, the particulate fines comprise superfines, which may have a maximum diameter of not greater than about 25 microns.

In one embodiment, a portion of feed stock may mean a predetermined weight or volume. In some embodiments, a portion of feed stock may be about 200 grams or 300 grams. In other embodiments, a portion of feed stock may be about 100 cubic centimeters or 200 cubic centimeters.

As used herein, "alumina" and the like means any of various forms of aluminum oxide. In one embodiment, alumina is used as an ingredient in the manufacturing of metallic aluminum via an electrolytic process.

As used herein, "feed stream" and the like means any pathway in the process of supplying a feed stock 16 from a feeder 14 to a portion of an aluminum electrolysis cell, e.g., cell superstructure 10. Examples of feed stream include funneling via a pipe, dumping using manual or mechanical devices, and transporting using a conveyor belt, to name a few. As shown in the figure, the feed stream is the pathway in which feed stock 16 is flowing downward from the feeder 14 to the electrolyte containing pot 12 near the bottom of the aluminum electrolysis cell.

In one embodiment, a measurement device 18 may be coupled to the cell superstructure 10. As shown, the measurement device 18 is coupled to a side of the feeder 14, the measurement device 18 being in communication with the feed stream. In one embodiment, the measurement device 18 is capable of receiving a first portion of the feed stock 16. In one embodiment, the measurement device 18 is capable of releasing a second portion of the feed stock 16 during a first time period. In one embodiment, the measurement device 18 is capable of determining at least one attribute associated with the feed stock 16 by correlating the first time period with the second portion of the feed stock 16.

As used herein, "measurement device" and the like means a device capable of receiving a first portion of a feed stock, releasing a second portion of a feed stock, determining at least one attribute associated with the feed stock, among other capabilities. In some embodiments, the attribute includes weight of the feed stock 16 and the amount of time it takes to release an amount of feed stock 16 contained within, among other attributes. In one instance, the first portion is the same as the second portion. In some instances, the second portion can be a part of the first portion, or the whole or same as the first portion. In one example, the portion of feed stock may be measured by mass or weight. In another example, the portion of feed stock may be measured by volume.

As used herein, "communication" and the like means the act of conveying information by electrical or physical contact. For example, the measurement device 18, e.g., funnel, can be coupled to the feeder 14 or the aluminum electrolysis cell for receiving the alumina, while the alumina is being supplied from the feeder 14 to the bath containing pot 12 within the aluminum electrolysis cell. In one embodiment, the funnel can be coupled to an exterior portion of at least one of the feeder 14, the cell superstructure 10, and a portion of an aluminum electrolysis cell. In another embodiment, the funnel can be coupled to an interior portion of at least one of the feeder 14, the cell superstructure 10, and a portion of an aluminum electrolysis cell. This will become more apparent in subsequent figures and discussion. In operation, after a pre-determined amount of alumina has been received, the funnel may release all or some of the alumina back into the feed stream. In these instances, the alumina may be released back into the feeder 14 or other parts of the aluminum electrolysis cell (e.g., the cell superstructure 10).

As used herein, "receiving" and the like means to store or come into possession of. For example, a measurement device 18 (e.g., funnel), in communication with a feed stream, is adaptable to receive a portion of a feed stock 16 (e.g., alumina). In one example, the alumina may be received through a first end of the funnel, the first end being an upper or open end of the funnel. Once received, the alumina may be stored within a conical portion of the funnel. In some examples, the amount of alumina received by the funnel can be from about 200 g to about 500 g.

As used herein, "releasing" and the like means to discharge or free from physical contact. For example, a measurement device 18 (e.g., funnel), in communication with a feed stream, is capable of releasing a portion of a feed stock 16 (e.g., alumina). In one example, the alumina 16 may be released from a second end of the funnel. In some instances, the second end is a lower or open end of a conical portion of the funnel. In one embodiment, the measurement device 18 may release the alumina back into the feed stream without any interruption. In some embodiments, the measurement device 18 may release the alumina into the feeder 14 or other parts of the aluminum electrolysis cell. In some embodiments, the alumina may be released to the feeder 14, the hopper, the cell superstructure 10, the pot 12, or other areas of the aluminum electrolysis cell.

As used herein, "attribute" and the like means characteristic or quality of a material. For example, attribute includes weight, particle size, flow rate, and concentration of the material, to name a few.

As used herein, "time period" and the like means an amount of time. For example, the measurement device 18 may include a clock or counter for determining the amount of time it takes for a pre-determined amount of alumina to leave the funnel. In one embodiment, a clock or timer may be coupled to the funnel. The time period, in conjunction with the amount of alumina released, may be used to calculate an alumina flow rate.

In one embodiment, the measurement device 18 comprises a funnel. In one instance, the funnel has a conical shape and includes associated hardware and software. In one embodiment, the funnel has a first end for receiving alumina and a second end for releasing the same. In some instances, the diameter of one end of the funnel can be from about 1 mm to about 10 mm. In some embodiments, the diameter of one end of the funnel can be not greater than about 10 mm, or not greater than about 8 mm, or not greater than about 6 mm, or not greater than about 4 mm, or not greater than about 2 mm. In some embodiments, the diameter of one end of the funnel can be not smaller than about 1 mm, or not smaller than about 3 mm, or not smaller than about 5 mm, or not smaller than about 7 mm, or not smaller than about 9 mm. In other embodiments, the diameter of one end of the funnel can be about 4 mm, or about 5 mm, or about 6 mm, or about 7 mm. In some embodiments, the funnel can be made of brass or stainless steel to minimize or prevent static charge. The portion of alumina received by the funnel may be determined by an infrared weight sensor. For instance, once a pre-determined amount of alumina has been received (e.g., 200 g), the measurement device 18 stops the receiving process by terminating access to the first or upper end of the funnel. Subsequently, the funnel may release the alumina stored therein and calculate an amount of time (e.g., 40 seconds) it takes for all or part of the alumina to leave the funnel using the same infrared weight sensor and corresponding timer. Dividing the amount of alumina (e.g., 200 g) released from the second or lower end of the funnel by the total amount of time it takes for that amount of alumina to leave the funnel (e.g., 40 seconds) allows an alumina flow rate to be calculated (e.g., 200 g/40 sec=5 g/sec). In this case, this particular batch of alumina has a flow rate of 5 grams per second since 200 grams of alumina was able to flow out of the funnel in 40 seconds. In other embodiments, the alumina flow rate may be calculated based on an amount of alumina captured divided by the time it takes for releasing the same.

In some instances, the alumina flow rate may be used to determine superfines concentrations within the alumina. In other instances, the measurement device 18 may include an extension rod or screw tube for determining the weight of an alumina sample. In addition, the measurement device 18 may include sensors for detecting when a receiving process begins and when the funnel has been filled to a certain level. Additional timers and sensors may be incorporated to determine a flow time including start and stop times.

As used herein, "flow rate" and the like means the speed of a powder that travels past a given location in a given amount of time. For example, an alumina flow rate may be determined by measuring an amount of alumina that travels through a funnel in a given amount of time. In some instances, the flow rate may be influenced by many factors including particle size, particle distribution, and moisture, to name a few. In one instance, the alumina flow rate is a property of particle size and may be influenced by the concentration of superfines within the feed stream. By measuring the flow rate of the alumina, the size of alumina particles within a batch of alumina can be predicted and determined. Generally, the higher flow rate is indicative of the alumina feed stock spending less time within the feed stream and may suggest lower superfines concentration and better alumina properties. Alternatively, the lower flow rate is indicative of the alumina feed stock spending more time within the feed stream and may suggest higher superfines concentration and worse alumina properties. Once the flow rate has been calculated and the concentration of superfines has been determined, the feed control parameters may be adjusted in real-time as necessary to optimize the efficiency of the aluminum production process and reduce environmental impact. The adjustments may include increasing or decreasing the amount of feed stock 16 within the feed stream, allowing the feed stock 16 to dissolve longer in the pot, and adjusting other process control parameters, to name a few.

For example, if it has been determined that the alumina flow rate is generally higher (e.g., higher in the first few hours of the morning), the frequency or amount of alumina being fed to the pot may be increased since the higher flow rate may be an indication of lower superfines concentration. In this instance, the feeding should be increased since the alumina readily dissolves in the pot and more alumina may be fed to increase production of metallic aluminum. Conversely, if it has been determined that the alumina flow rate is generally lower (e.g., lower in the last few hours of the evening), the frequency or amount of alumina being fed to the pot may be decreased or slowed down since the lower flow rate may be an indication of higher superfines concentration. And that it would be better for the alumina to spend more time within the pot so that it may eventually dissolve and be consumed during electrolysis. In some embodiments, different batches of alumina may be incorporated if the change in feed rate does not result in higher alumina flow rate, in addition to manipulating other feed control parameters.

As used herein, "superfines" and the like means alumina particles that are generally less than about 20 microns. In general, alumina particle sizes can be anywhere from submicron to about 150 microns. Typical mean size alumina particles have diameters ranging from about 85 to about 95 microns. In one embodiment, controlling the concentrations of superfines may lead to enhancements including minimized muck generation and improved current efficiency, to name a few. By determining the flow rate of the alumina powder in real-time, the dissolution rate of alumina within the electrolytic process may be predicted thereby allowing operating efficiency of each aluminum electrolysis cell to be closely maintained and monitored.

As shown in FIG. 3, the funnel 18 may include an extension rod 19 for receiving the alumina stored within the feeder 14. In this instance, as alumina is flowing within the feed stream of the cell superstructure 10, the funnel 18 and the extension rod 19 is able to capture at least a portion of the alumina without significantly interrupting the aluminum smelting process. In one example, the alumina may be collected during a period equal to an overfeeding time. In this instance, from about 30 to about 45 minutes. The alumina may be collected by the funnel 18 from the cell superstructure in the region of the feeder 14.

In one embodiment, the funnel 18 may include an automatic alumina sampler (not shown) for automatically capturing the alumina and sending the same to the body of the funnel. In another embodiment, the automatic alumina sampler is capable of receiving a portion of the alumina prior to the alumina being supplied to the liquid bath within the pot 12. In these instances, if the funnel 18 ceases to function, there may be no interruption of the alumina feeding cycle.

The funnel 18 may be gradually filled with collected alumina and scanned by the sampler. The sampling time should be sufficient to provide a minimal amount of alumina inside the funnel 18 but less than total capacity. In one embodiment, the amount of alumina should be consistent from one measurement cycle to another.

In some embodiments, the installation of the funnel 18 may depend on the design of the feeder 14 and/or the pot 12. For example, the funnel 18 may be installed on the inside of the cell superstructure substantially adjacent the discharge region of an alumina feeder 14 or any other areas having sufficient room for receiving the funnel 18. In other examples, the funnel 18 may be installed on the outside of the cell superstructure and coupled to the feed stream of the feeder 14 via pipes and tubes. In short, the funnel 18 may be suitably coupled to the cell superstructure regardless of the design, shape and size of the feeder 14 and/or the pot 12 so long as the funnel 18 maintains communication with the feed stream.

In one embodiment, part controllers (PC's) and may be coupled to the funnel 18 for controlling and actuating the funnel 18. The controllers may also facilitate motor control and associated hardware and software programming of the funnel 18.

In one embodiment, the funnel 18 may receive a first portion of the alumina from a top end (larger opening of the funnel 18) as supplied from the extension rod 19, and release a second portion of the alumina from a bottom end (smaller opening of the funnel 18) back into the feed stream. In one example, the bottom end of the funnel 18 may open and the top end may close to stop sampling of additional alumina through an input part controller command. The time it will take for the alumina to exit from the bottom end of the funnel 18 may be automatically determined by a timer. In some instances, the second portion may be a part of the first portion, or the whole or same as the first portion. As shown, the bottom end may include another extension rod 17 for returning the alumina to the feed stream within the cell superstructure 10.

Before the alumina is returned to the feed stream, the funnel 18 and associated sensors, motors (e.g., input/output part controller), and timers, among other hardware and software devices, are capable of measuring, recording and transmitting at least one attribute associated with the alumina captured within the feed stream. In this instance, the attribute includes weight, flow rate, concentration and particle size of the alumina, to name a few. In one embodiment, the funnel and associated weight sensor, motors, and timer are capable of communicating the measured attribute to a host computer via a network (not shown).

Once the alumina flow time through the funnel 18 has been automatically determined, it may subsequently be transmitted to the part controller and then to computer control. In some instances, the alumina flow time through the funnel 18 may be available at the beginning of an underfeed. The feed control parameters may be adjusted according to the alumina flow time through the funnel 18. In some embodiments, slope target at the end of an underfeed, ratio and slope for overfeed optimization, base feed rate and percentage of feed rate during underfeed are some of the factors that may be adjusted based on alumina quality.

As used herein, "host computer" and the like means a network computer or server dedicated to running at least one application. In some instances, a host computer may include associated database, hardware and software for controlling the aluminum electrolysis cell, the feeder 14, and the measurement device 18, among other devices and components. In some embodiments, the measurement device 18 may include associated hardware and software for communicating the attribute to a host computer via a network.

As used herein, "network" and the like means an interconnected communication system. For example, the Internet, a company's Intranet or local area network (LAN), and the World Wide Web are networks.

Although the measurement device 18 as shown in FIG. 1 is externally coupled to an exterior portion of the feeder 14, it may be possible for the measurement device 18 to be externally coupled to other parts of the cell superstructure 10. In some embodiments, the measurement device 18 may also be internally coupled to a portion of the feeder 14, or to other parts within the cell superstructure 10. This will become more apparent in subsequent figures and discussion.

Figure 4:
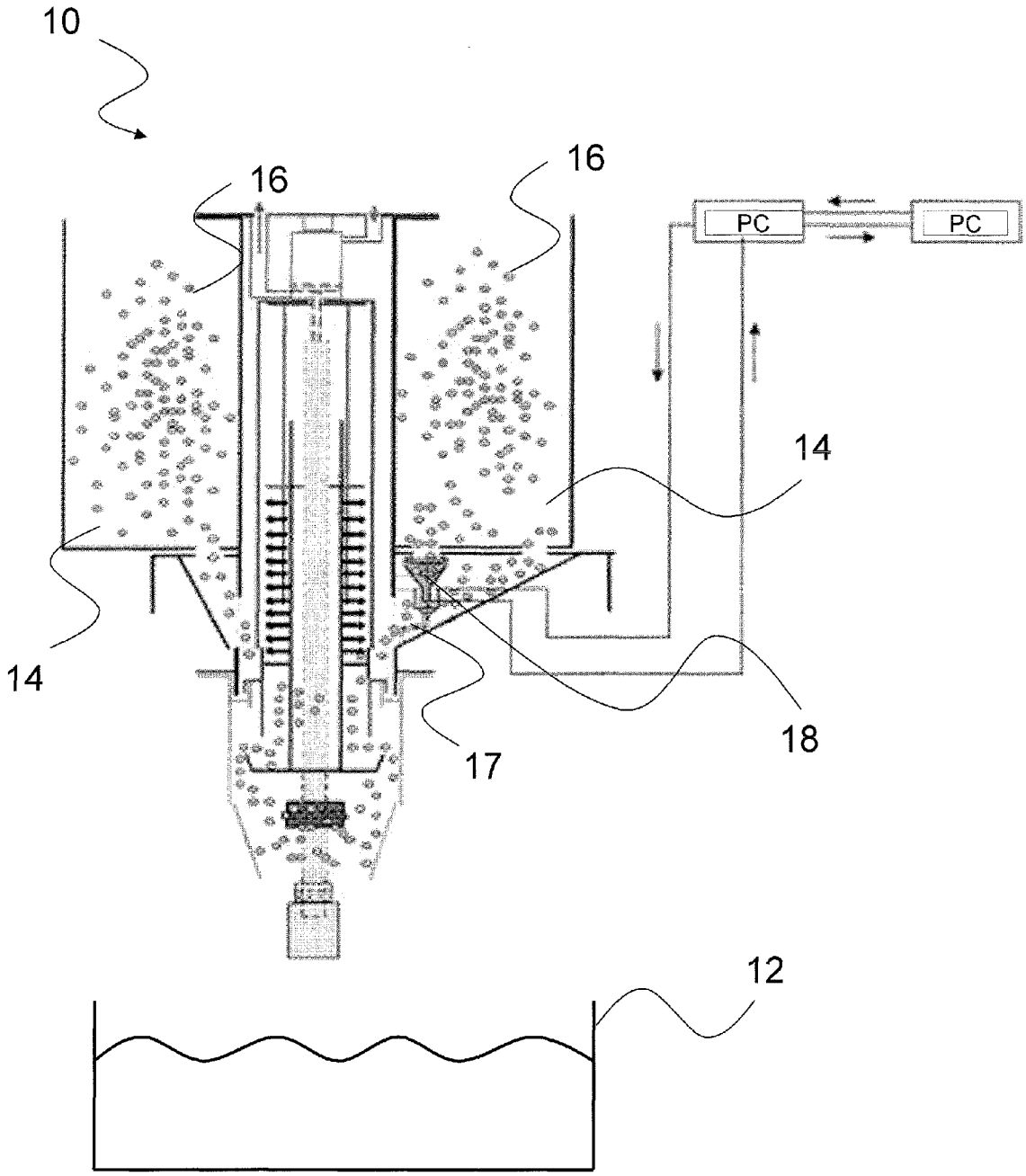
FIG. 4 illustrates one embodiment of a measurement device coupled to an aluminum electrolysis cell.

FIG. 4 illustrates another embodiment of an aluminum electrolysis cell having a measurement device 18 coupled within an interior portion of the cell superstructure 10. Specifically, the funnel 18 is coupled underneath the feeder 14 in communication with the feed stream. In this instance, the funnel 18 is capable of receiving and releasing a portion of alumina within the feed stream, and determining at least one attribute associated with the alumina similar to that described above. In this example, no extension rod is necessary to direct the alumina into the funnel 18. Similarly, an extension rod 17 may be utilized for releasing some or all of the captured alumina back into the feed stream, although the extension rod 17 may not be necessary in some cases.

Figure 5:
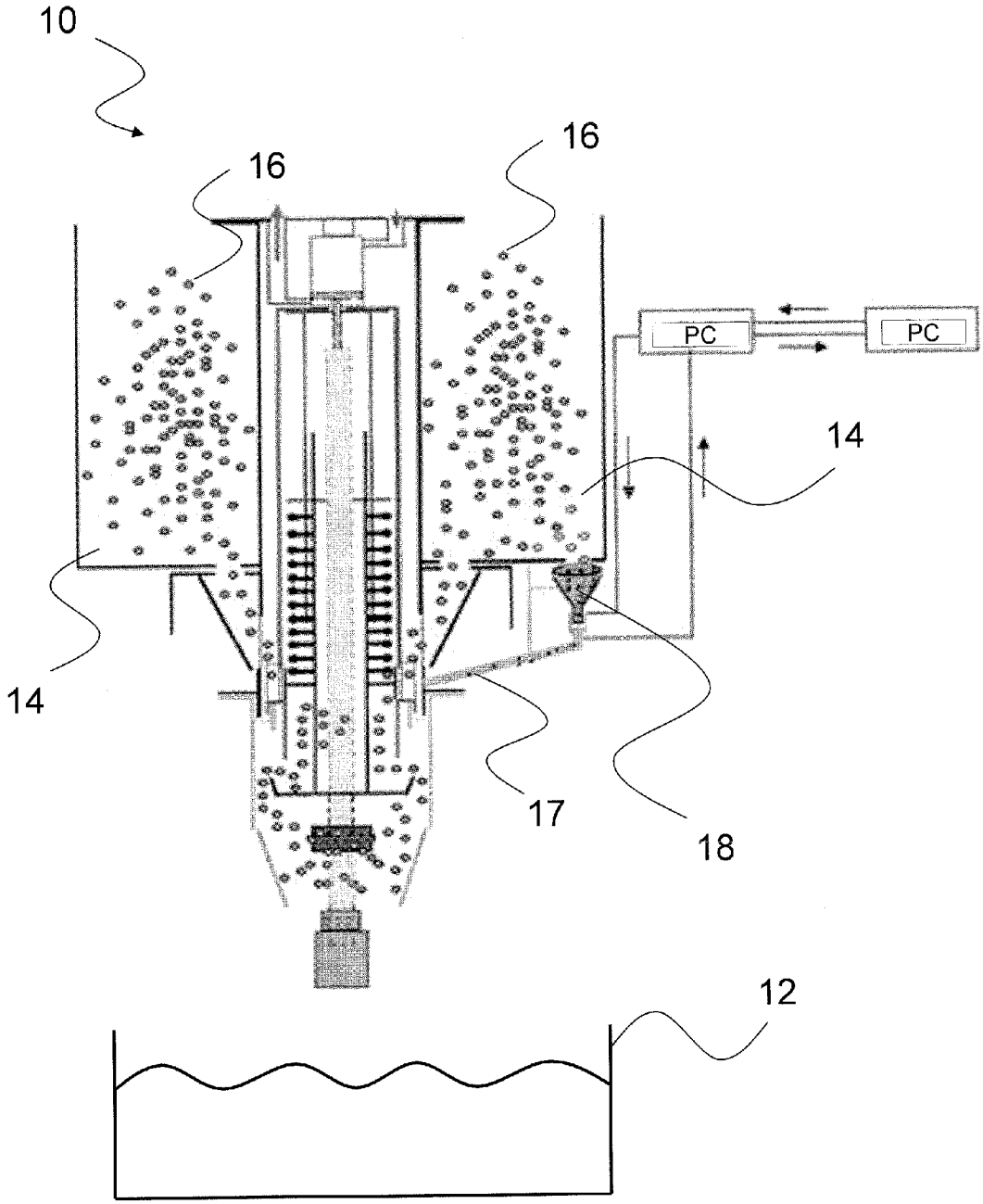
FIG. 5 illustrates one embodiment of a measurement device coupled to an aluminum electrolysis cell.

FIG. 5 illustrates yet another embodiment of an aluminum electrolysis cell having a measurement device 18 coupled to the outside of the cell superstructure 10. Specifically, the funnel 18 is coupled underneath the feeder 14. In this instance, the funnel 18 is capable of receiving and releasing a portion of the alumina within the feed stream, and determining at least one attribute associated with the alumina similar to that described above. In this example, no extension rod is necessary for directing the alumina into the funnel 18, but an extension rod 17 may be utilized for releasing some or all of the captured alumina back into the feed stream.

Another embodiment of the present disclosure discloses a method of measuring alumina qualities and communicating the same by: (a) supplying a feed stock 16 via a feed stream to an aluminum electrolysis cell; (b) receiving a first portion of the feed stock 16 via a measurement device 18; (c) releasing a second portion of the feed stock 16 from the measurement device 18 over a first time period; and (d) determining a first attribute associated with the feed stock 16, wherein the determining comprises correlating the first time period to a second attribute of the second portion of the feed stock 16.

In one embodiment, the measurement device 18 is in communication with the feed stream. In one embodiment, the second portion of the feed stock 16 is released into the feed stream. In some embodiments, the attribute comprises at least one of weight, particle size, flow rate and concentration of the feed stock 16.

In one embodiment, the method further includes: (e) communicating the attribute to a host computer via a network. In another embodiment, the method further includes: (f) adjusting alumina feed control including at least one of feed rate of the feed stream based on the attribute.

In some embodiments, the feed control parameters that may be adjusted include feed rate, alumina ore feeding control, alumina ore control parameters such as adjusting feeding rate, and adjusting alumina feed control with no parameters, among others. In one embodiment, the feeding rate is the same as the alumina electrolysis rate. In this instance, as long as the amplitude is not changing, the feed rate would be the same.

The presently disclosed embodiments may facilitate the monitoring of superfines concentration by measuring alumina flow rate. The ability to monitor the quality of alumina may facilitate in the reduction of muck formation and anodic effect during aluminum electrolysis. In some instances, the real-time measurement of alumina flow rate may allow the prediction of alumina dissolution rate, thereby allowing real-time adjustment of aluminum qualities for reducing muck formation and anodic effect.

Although the disclosure has been described in detail with reference to several embodiments, additional variations and modifications exist within the scope and spirit of the disclosure as described and defined in the following claims.

What is claimed is:

1. A system comprising:

an aluminum electrolysis cell;

a feeder configured to supply a feed stock via a feed stream to the aluminum electrolysis cell; and a measurement device in communication with the feed stream, wherein the measurement device is adapted to receive a first portion of the feed stock, wherein the measurement device releases a second portion of the feed stock during a first time period, and wherein the measurement device is adapted to determine at least one attribute associated with the feed stock by correlating the first time period with the second portion of the feed stock.

2. The system of claim 1, wherein the second portion of the feed stock is released into the feed stream.

3. The system of claim 1, wherein the attribute comprises at least one of weight, flow rate, concentration and particle size of the feed stock.

4. The system of claim 1, wherein the measurement device is adapted to communicate the attribute to a host computer via a network.

5. The system of claim 1, wherein the feed stock comprises alumina.

6. The system of claim 1, wherein the measurement device is coupled to an exterior portion of at least one of the aluminum electrolysis cell and the feeder.

7. The system of claim 1, wherein the measurement device is coupled to an interior portion of at least one of the aluminum electrolysis cell and the feeder.

8. The system of claim 1, wherein the measurement device comprises a funnel.

9. A method comprising:

(a) supplying a feed stock via a feed stream to an aluminum electrolysis cell;

(b) receiving a first portion of the feed stock via a measurement device;

(c) releasing a second portion of the feed stock from the measurement device over a first time period; and (d) determining a first attribute associated with the feed stock, wherein the determining comprises correlating the first time period to a second attribute of the second portion of the feed stock.

10. The method of claim 9, wherein the measurement device is in communication with the feed stream.

11. The method of claim 9, wherein the second portion of the feed stock is released into the feed stream.

12. The method of claim 9, wherein the attribute comprises at least one of weight, particle size, flow rate and concentration of the feed stock.

13. The method of claim 9, further comprising:

(e) communicating the attribute to a host computer via a network.

14. The method of claim 13, further comprising:

(f) adjusting alumina feed control including at least one of feed rate of the feed stream based on the attribute.

15. A method comprising:

(a) supplying a feed stock in a feed stream to an aluminum electrolysis cell;

(b) receiving a portion of the feed stock using a measurement device;

(c) releasing the portion of the feed stock from the measurement device over a time period;

(d) determining an attribute associated with the feed stock, wherein the determining comprises correlating the time period to the attribute of the feed stock;

(e) communicating the attribute to a host computer using a network; and (f) adjusting alumina feed rate of the feed stream based on the attribute of the feed stock.

16. The method of claim 15, wherein the measurement device is in communication with the feed stream.

17. The method of claim 15, wherein the portion of the feed stock is released into the feed stream.

18. The method of claim 15, wherein the attribute comprises at least one of weight, particle size, flow rate and concentration of the feed stock.

* * * * *